United States Patent [19]

Nonnenmann et al.

[11] 4,159,741

[45] Jul. 3, 1979

[54] HEAT EXCHANGER

[75] Inventors: Manfred Nonnenmann, Schwieberdingen; Helmut Bardong, Stuttgart, both of Fed. Rep. of Germany

[73] Assignee: Süddeutsche Kühlerfabrik Julius Fr. Behr, Stuttgart, Fed. Rep. of Germany

[21] Appl. No.: 709,579

[22] Filed: Jul. 28, 1976

Related U.S. Application Data

[63] Continuation of Ser. No. 518,146, Oct. 25, 1974, abandoned.

[51] Int. Cl.[2] ..... F28F 9/16

[52] U.S. Cl. ..... 165/173; 29/157.4; 29/523; 285/222; 285/382.4

[58] Field of Search ..... 165/79, 173, 175, 178, 165/149, 151, 153; 29/157.4, 523, 157.3 C; 285/222, 382.4, 381, 189

[56] References Cited

U.S. PATENT DOCUMENTS

| | | | |
|---|---|---|---|
| 513,620 | 1/1894 | Phillips | 165/173 |
| 993,883 | 5/1911 | Schickert | 285/189 |
| 2,488,627 | 11/1949 | Hisey | 165/151 |
| 2,573,161 | 10/1951 | Tadewald | 165/153 |
| 2,886,881 | 5/1959 | Huet | 285/381 |
| 3,027,142 | 3/1962 | Albers et al. | 165/149 |
| 3,283,402 | 11/1966 | Larson | 29/523 |
| 3,557,903 | 1/1971 | Straw | 285/222 |
| 3,583,478 | 6/1971 | Fieni | 165/178 |
| 3,787,945 | 1/1974 | Pasek et al. | 29/157.4 |

FOREIGN PATENT DOCUMENTS

| | | | |
|---|---|---|---|
| 258025 | 2/1939 | Italy | 29/157.4 |

*Primary Examiner*—Sheldon Richter
*Attorney, Agent, or Firm*—Browdy and Neimark

[57] ABSTRACT

A passage is provided in a heat exchanger water compartment to permit expansion of a tube following its introduction into the bottom of the compartment. The heat exchanger is constructed so that a parameter $K_1$ is in the range of 1.2 to 8. This parameter is equal to the length of the surface in contact between the tube and the passage multiplied by the ratio of the thickness of the bottom to the thickness of the tube wall, and the ratio of the tensile strength of the bottom material to the tensile strength of the tube material.

8 Claims, 1 Drawing Figure

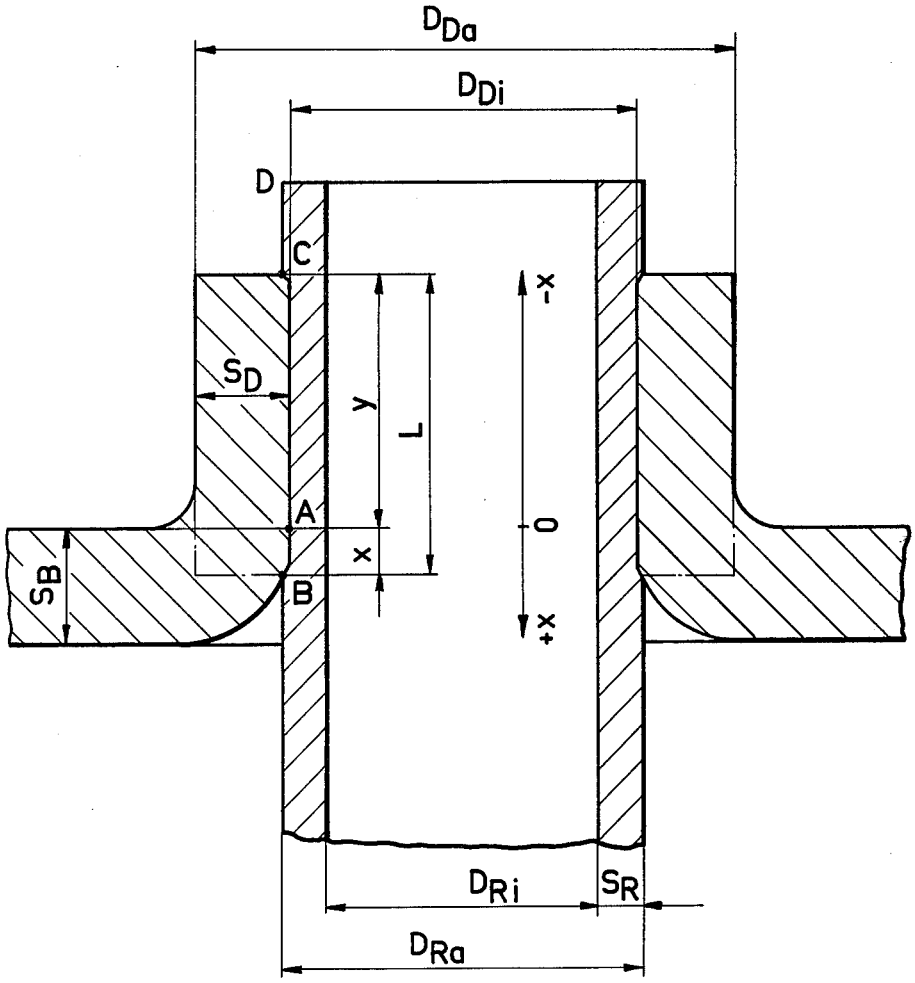
$D_{Da}$
$D_{Di}$
D
C
$S_D$
y
L
-x
A
x
0
$S_B$
B
+x
$D_{Ri}$
$S_R$
$D_{Ra}$

HEAT EXCHANGER

This is a continuation of application Ser. No. 518,146, filed Oct. 25, 1974, now abandoned.

FIELD OF THE INVENTION

The invention concerns heat exchangers, preferably for motor vehicles, consisting of a water compartment and a finned tube connected to the bottom of the water compartment, especially those in which passages are provided for the tubes in the water compartment bottom.

BACKGROUND OF THE INVENTION

The seal between the bottom of the water compartment and the tubes in heat exchangers poses particular difficulties, especially in so-caled "seamless" heat exchangers, in which the tubes are not soldered to the water compartment while thin bottoms and thin tubes are used.

It is known to expand the tubes conically by appropriate presses following assembly with the water compartment bottom, in order thereby to produce a firm seat in the water compartment bottom. It is also known to provide the water compartment bottom in the immediate vicinity of each tube with an annular flange, a so-called "passage", which surrounds the tube for a specific portion of its length. In known heat exchangers of this type, sealing elements are provided between the passage and tube.

SUMMARY OF THE INVENTION

It is an object of this invention to overcome the defects of the prior art as mentioned above.

Another object of the invention is to provide a connection between the tubes and water compartment bottom in a heat exchanger of the type described hereinabove without using additional sealing elements, said connection being sufficiently stable with respect to compressive and tensile forces, and exhibiting adequate strength to be tight with respect to water and air and mechanical vibrations such as are encountered particularly during the operation of motor vehicles.

BRIEF DESCRIPTION OF THE DRAWING

FIGURE 1 is a cross-sectional view of the invention showing the individual symbols and their meaning.

DETAILED DESCRIPTION

A tight seal between the tubes and the water compartment is accomplished according to the invention primarily by virtue of the fact that the tubes are expanded following their introduction into the bottom and the value of a first parameter $K_1$ $$K_1 = L \cdot (S_B/S_R) \cdot (\delta_B/\delta_B)$$

is in the range between 1.2 and 8.

The symbols employed have the following meanings:

$L$ = Length of area of contact between tube and passage (mm)

x = The length between the point (A) on the surface of the tube corresponding to the top surface of the water compartment bottom and the lowest point (B) n the surface of the tube which is in contact with the passage, x being positive when B is below A (mm).

y = The length of the passage extending above point A (mm)

$S_B$ = Wall thickness of bottom (original condition) (mm)

$S_D$ = Wall thickness of passage following expansion of tube (mm)

$S_R$ = Wall thickness of tube prior to expansion (mm)

$\delta_B$ = Tensile strength of bottom material (kp·mm$^{-2}$)

$\delta_R$ = Tensile strength of tube material (kp·mm$^{-2}$)

$D_{Da}$ = Outside diameter of passage following expansion (mm)

$D_{Di}$ = Internal diameter of passage following expansion (mm)

$D_{Ri}$ = Internal diameter of tube (mm)

$D_{Ra}$ = Outside diameter of tube (mm)

$E_R$ = Elasticity modulus of tube material (kp·mm$^{-2}$)

$E_B$ = Elasticity modulus of passage (kp·mm$^{-2}$)

The first parameter $K_1$ is critical for achieving sufficient tightness of the tube-bottom connection. Theoretically, only a single closed and tight annular line is required for this purpose ($L \rightarrow 0$). However, this cannot be accomplished for technical reasons. Therefore, in order to achieve a tight connection, it is necessary, according to the invention, to assume that the height of the passage L, in conjunction with the strength paramers $\delta_B$ and $\delta_R$ of $K_1$ must have a specific value.

It is particularly advantageous if a second parameter $K_2$ with $$K_2 = L \cdot D_{Ra} \cdot (\delta_B/\delta_R)$$

is in the range between 7 and 30, and that further a third parameter $K_3$ $$K_3 = L/S_B$$

is in the range between 0.8 and 4.

The frictional forces between the tube and the bottom passage is important with respect to withstanding forces that can act in the axial direction of the tube on the connection between the tube and the bottom. These frictional forces depend on the one hand on the area of contact between the tube and the bottom passage, (the passage length L multiplied by the outside diameter of the tube $D_{Ra}$) and the ratio between the strengths of the bottom and the tube. It is advantageous in this regard if the length L of the bottom passage in contact with the tube relative to the wall thickness of the bottom $S_B$, i.e. the parameter $K_3$ is between 0.8 and 4 in the range indicated.

According to a further feature of the invention, a fourth parameter $K_4$ is defined by $$K_4 = L \cdot (D_{Da}^2 - D_{Di}^2) \cdot (\delta_B/d_{Di}) \cdot 10^{-2}$$

and $K_4$ is in the range between 0.4 and 2.5.

The bottom passage should counteract the force exerted outward by the tube in the radial direction and therefore requires a specific strength which depends upon both $\delta_B$ and the geometry of the passage. The internal diameter of the passage bears a certain relationship to the area of contact with the tube.

In order to relate the strength values of the bottom to the strength of the tube, a fifth parameter $K_5$ in the following advantageous form is needed.

$$K_5 = L \cdot (D_{Da}^2 - D_{Di}^2) \cdot (\delta_B/\delta_R) \cdot (1/D_{Di}),$$

so that its value is between 2 and 12. In order to take partial lengths x and y of passage L adequately into account, depending whether x is positive or negative, according to the invention, a parameter $K_6$ is defined:

$$K_6=(D_{Da}^2-D_{Di}^2)\cdot L'\cdot\delta_B\cdot 10^{-3}$$

it is desirable for it to be in the range of between 0.4 and 2.5, so that for $$x>0,\ L'=(2x+y)$$

and for $$x<0,\ L'=y-|x|.$$

It has been shown to be particularly advantageous if it is ensured in the forming of the passages that $S_D$ is less than $S_B$.

In order to ensure that the tube has a particularly firm mounting in the passage following expansion, it is advantageous for the length $\overline{CD}$ of a part of tube T projecting beyond the passage to be equal to $$\overline{CD}\leqq 2(S_R)$$

The drawing shows only a single connection between a tube and a water compartment bottom and a corresponding passage. Since the remaining construction of the heat exchanger is arbitrary, the water compartment top, fine-panels, etc., are not shown.

Heat exchangers according to the invention can be constructed to particular advantage with very thin bottoms and very thin-walled tubes. $S_B$ sould be less than 3.0 mm and wall thickness $S_R$ should be less than 1.5 mm. A consideration of the equilibrium will show that in the connection between the tube and the bottom, the compressive forces acting outward and produced by the tube must be in equilibrium with the forces acting inward from the bottom to the tube. The stress $\delta$ between the tube and the bottom is therefore dependent upon the elasticity modulus E and the increase in diameter for the given diameter $\Delta D$ so that for $\delta$we will have:

$$\delta=E\cdot\Delta D/D.$$

Then we will see from the following formula:

$$\frac{E_R\cdot\dfrac{\Delta D_R\cdot S_R}{(D_{\bar{R}})^2}}{E_B\cdot\dfrac{\Delta D_D\cdot S_D}{(D_{\bar{D}})^2}}$$

that the value of this expression must be in the range from 0.7 to 2.

For reasons of simplification, the average diameters $D_{\bar{R}}$ and $D_{\bar{D}}$ have been used in these formulas. Consideration has been given to the fact that the elasticity moduli E of the bottom and tube which have been used are not exactly identical to the elasticity moduli that actually develop in the connection between the tube and the bottom.

What is claimed is:

1. In a heat exchanger having a thin-bottomed water compartment and a block of thin-walled finned tubes connected to the bottom of the water compartment, wherein the wall thickness of the bottom of the water compartment is less than 3.0mm and the wall thickness of the tubes is less than 1.5 mm, and wherein flange passages are provided in the bottom for the tubes, the improvement wherein the tubes are connected to the passages in the water compartment bottom by expansion alone without additional sealing means and wherein the dimensions and properties of the water compartment bottom and the tubes are selected such that the value of a first parameter $K_1$is in the range between 1.2 and 8, where $$K_1=L\cdot(S_B/s_R)\cdot(\delta_B/\delta_R),$$

L=the length in mm of the surface of the tube in contact with the passage, $S_B$=the wall thickness in mm of the water compartment bottom in the original condition thereof, $S_R$=the wall thickness in mm of the tube prior to expansion, $\rho_B$=the tensile strength of the material of the water compartment bottom in $K_p\cdot mm^{-2}$, and $\rho_R$=the tensile strength of the tube material in $K_p\cdot mm^{-2}$.

2. A heat exchanger in accordance with claim 1 wherein the dimensions and properties of the water compartment bottom and tubes are further selected such that the value of a second parameter $K_2$ is in the range between 7 and 30, where $$K_2=L\cdot D_{Ra}\cdot(\rho_B/\rho_R),\text{ and}$$

$D_{Ra}$=the outside diameter in mm of the tube; and further such that a third parameter $K_3$ is in the range of between 0.8 and 4, where $$K_3=L/S_B.$$

3. A heat exchanger in accordance with claim 1 wherein the dimension and properties of the water compartment bottom and tubes are further selected such that the value of a further parameter $K_4$ is in the range between 0.4 and 2.5, where $$K_4=L\cdot(D_{Da}^2-D_{Di}^2)\cdot(\rho_B/D^{Di}\cdot 10^{-2},$$

$D_{Da}$=outside diameter in mm of the passage after expansion, and $D_{Di}$=inside diameter in mm of the passage after expansion.

4. A heat exchanger in accordance with claim 1, wherein the dimensions and properties of the water compartment bottom and tubes are further selected such that the value of a further parameter $K_5$ is in the range between 2 and 12, where $$K_5=L\cdot(D_{Da}^2-D_{Di}^2)\cdot(\rho_B\rho_R)\cdot\cdot(1/D_{Di})$$

$D_{Da}$=outside diameter in mm of the passage after expansion, and $D_{Di}$=inside diameter in mm of the passage after expansion.

5. A heat exchanger in accordance with claim 1 wherein the dimensions and properties of the water compartment bottom and tubes are further selected such that the value of a further parameter $K_6$ is in the range between 0.4 and 2.5, where $$K_6=(D_{Da}^2-D_{Di}^2)\cdot 2)\cdot L'\cdot\rho_B\cdot 10^{-3},$$

$D_{Da}$= outside diameter in mm of the passage after expansion, $D_{Di}$=inside diameter in mm of the passage after expansion, $L'=(2x+y)$ when $x<0$ and $y-|x|$ when $x<0$, x= the length in mm between the point (A) on the surface of the tube corresponding to the top surface of the water compartment bottom and the lowest point (B) on the surface of the tube which is in contact with the passage, x being positive when B is below A, and y = the length in mm of the passage extending above point A.

6. A heat exchanger in accordance with claim 1 wherein the wall thickness of the passage is smaller than the wall thickness of the water compartment bottom in the original condition thereof.

7. A heat exchanger in accordance with claim 1 wherein the length of the portion of the tube projecting beyond the passage is greater than or equal to twice the wall thickness of the tube prior to expansion.

8. A heat exchanger in accordance with claim 1 wherein said flange passages are directed into the water compartment.

* * * * *

UNITED STATES PATENT AND TRADEMARK OFFICE

CERTIFICATE OF CORRECTION

PATENT NO. : 4,159,741

DATED : July 3, 1979

INVENTOR(S) : NONNENMANN et al

It is certified that error appears in the above-identified patent and that said Letters Patent are hereby corrected as shown below:

Column 1, line 56, the formula should read:

-- $K_1=L\cdot(S_B/S_R)\cdot(\delta_B/\delta_R)$ -- line 66, "n" should read --on--

Column 2, line 38, "is" should read --are-- line 52, the formula should read:

-- $K_4=L\cdot(D_{Da}{}^2-D_{Di}{}^2)\cdot(\delta_B/D_{Di})\cdot 10^{-2}$ --

Column 3, line 20, the formula should read:

-- $\overline{CD}\geqq 2(S_R)$ -- line 25, "fine-panels" should read --fin-panels-- line 28, "sould" should read --should-- line 37, "δwe" should read --δ we--

Column 4, line 2, "$K_1$is" should read --$K_1$ is-- line 5, the formula should read:

-- $K_1=L\cdot(S_B/S_R)\cdot(\delta_B/\delta_R)$, -- line 13, "$\rho_B$" should read --$\delta_B$--

UNITED STATES PATENT AND TRADEMARK OFFICE

CERTIFICATE OF CORRECTION

PATENT NO. : 4,159,741

DATED : July 3, 1979

INVENTOR(S) : NONNENMANN et al

It is certified that error appears in the above-identified patent and that said Letters Patent are hereby corrected as shown below:

Column 4, line 14, "$K_p \cdot mm^{-2}$" should read --$kp \cdot mm^{-2}$-- line 15, "$\rho_R$" should read --$\delta_R$-- line 16, "$K_p \cdot mm^{-2}$" should read --$kp \cdot mm^{-2}$-- line 22, the formula should read:

-- $K_2 = L \cdot D_{Ra} \cdot (\delta_B / \delta_R)$ -- line 36, the formula should read:

-- $K_4 = L \cdot (D_{Da}^2 - D_{Di}^2) \cdot (\delta_B / D_{Di}) \cdot 10^{-2}$ -- line 47, the formula should read:

-- $K_5 = L \cdot (D_{Da}^2 - D_{Di}^2) \cdot (\delta_B \delta_R) \cdot (1/D_{Di})$ -- line 59, the formula should read:

-- $K_6 = (D_{Da}^2 - D_{Di}^2) \cdot L' \cdot \delta_B \cdot 10^{-3}$ --

UNITED STATES PATENT AND TRADEMARK OFFICE

CERTIFICATE OF CORRECTION

PATENT NO. : 4,159,741

DATED : July 3, 1979 page 3

INVENTOR(S) : NONNENMANN et al (of 3)

It is certified that error appears in the above-identified patent and that said Letters Patent are hereby corrected as shown below:

Column 4, line 65, "x<0" before "and" should read --x>0--

Signed and Sealed this

*Twenty-second* Day of *January 1980*

[SEAL]

*Attest:*

SIDNEY A. DIAMOND

*Attesting Officer* *Commissioner of Patents and Trademarks*

UNITED STATES PATENT AND TRADEMARK OFFICE

CERTIFICATE OF CORRECTION

PATENT NO. : 4,159,741

DATED : July 3, 1979

INVENTOR(S) : NONNENMAN et al.

It is certified that error appears in the above-identified patent and that said Letters Patent are hereby corrected as shown below:

Column 4, line 47, the formula should read:

$$--K_5 = L \cdot (D_{Da}^{2} - D_{Di}^{2}) \cdot (\delta_b / \delta_r) \cdot (1/D_{Di})--$$

Signed and Sealed this

*Twenty-seventh* Day of *May 1980*

[SEAL]

*Attest:*

SIDNEY A. DIAMOND

*Attesting Officer*

*Commissioner of Patents and Trademarks*